US007300037B2

(12) United States Patent
Beirne, Jr. et al.

(10) Patent No.: US 7,300,037 B2
(45) Date of Patent: Nov. 27, 2007

(54) PROTECTION DEVICE FOR ROOF OPENINGS

(75) Inventors: D. Peter Beirne, Jr., Westerville, OH (US); John Sells, Columbus, OH (US)

(73) Assignee: Winchester Fabricators, Inc., Columbus, OH (US)

( * ) Notice: Subject to any disclaimer, the term of this patent is extended or adjusted under 35 U.S.C. 154(b) by 0 days.

(21) Appl. No.: 10/784,139

(22) Filed: Feb. 20, 2004

(65) Prior Publication Data

US 2004/0232402 A1 Nov. 25, 2004

Related U.S. Application Data

(60) Provisional application No. 60/448,638, filed on Feb. 20, 2003.

(51) Int. Cl.
*E04H 17/00* (2006.01)
*E04H 17/14* (2006.01)

(52) U.S. Cl. ..... 256/64; 256/65.09; 256/65.14; 256/66

(58) Field of Classification Search ..... 256/59, 256/65.05, 65.14, 66, 24, 25, 31; 52/200, 52/DIG. 12; 182/45, 113
See application file for complete search history.

(56) References Cited

U.S. PATENT DOCUMENTS 4,600,179 A * 7/1986 Willetts ..... 256/67
5,312,089 A * 5/1994 Venegas, Jr. ..... 256/65.12
D354,817 S 1/1995 Kovacs
5,502,934 A 4/1996 Coyne
5,667,199 A * 9/1997 Hamm ..... 256/67
5,820,497 A * 10/1998 Pena ..... 473/471
6,272,800 B1 * 8/2001 Phinney et al. ..... 52/200
6,298,745 B1 10/2001 Rixon
6,520,461 B1 * 2/2003 Graham ..... 248/188.8
6,643,982 B1 * 11/2003 Lapp et al. ..... 52/127.2
6,679,481 B2 * 1/2004 McNalley et al. ..... 256/65.12
6,688,046 B2 * 2/2004 Perkins ..... 52/19
6,860,472 B2 * 3/2005 Striebel et al. ..... 256/65.03
2004/0104382 A1 * 6/2004 Collins et al. ..... 256/59

* cited by examiner

*Primary Examiner*—Daniel P. Stodola
*Assistant Examiner*—Joshua T Kennedy
(74) *Attorney, Agent, or Firm*—Porter, Wright, Morris & Arthur LLP

(57) ABSTRACT

A fall protection device for an opening in a roof includes at least one rail section having a vertical member. The vertical member is preferably in the form of a metal tube having an open lower end. A bearing foot has a connecting portion and a bearing portion and is secured to the lower end of the vertical member by the connecting portion so that the bearing portion supports the vertical member above the roof. The connecting portion of the bearing foot preferably extends into the open lower end of the tube and resiliently engages an interior surface of the tube to secure the bearing foot thereto. A hardness of the bearing portion is greater than a hardness of the connecting portion. The connecting portion and the bearing portion are preferably plastic and co-molded so that the bearing foot is of unitary construction.

19 Claims, 5 Drawing Sheets

PROTECTION DEVICE FOR ROOF OPENINGS

CROSS-REFERENCE TO RELATED APPLICATIONS

This application claims priority from provisional patent application No. 60/448,638 filed Feb. 20, 2003, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to a protective device for roof and floor openings and, more particularly, to a protective device which prevents people from accidentally falling through roof and floor openings.

BACKGROUND OF THE INVENTION

One type of roof opening is a domed skylight. Domed skylights present a constant danger to roof and utility workers who are present on the roof. The domes of the skylights cannot support the weight or force of a fallen person. As a result, there have been many deaths and serious injuries due to collapse and breakage of the domes upon impact which sends the fallen person crashing to the floor below.

The Occupational Safety and Health Administration (OSHA) has promulgated regulations requiring employers to provide fall protection to workers. OSHA regulations require "every skylight, floor opening, and hole shall be guarded by a standard screen or fixed standard railing on all exposed sides" (29 C.F.R. 1910.23(a)(4)). OSHA regulations also require "each employee on walking/working surfaces shall be protected from falling through holes (including skylights) more than six feet (1.8 m) above lower levels, by personal fall arrest systems, covers, or guardrail systems erected around such holes" (29 C.F.R. 1926.501(b)(4)(i)).

One type of fall protection device is a skylight mesh or screen system extending over the domed skylight. The mesh or screen extends over and covers the domed skylight and is typically secured to the frame of the skylight but not the roof. While these mesh or screen systems are effective in providing suitable fall protection, the mesh or screen can be visible directly through the skylight or can create shadowing effects on the skylight or the floor below. In some applications it is desirable for the fall protection device to be invisible or nearly invisible through the skylight and to create no shadowing effects.

A skylight rail system has been developed for circumstances where the fall protection is desired to be invisible through the dome. The rail extends around the domed skylight and is typically supported by the roof but secured to the skylight but not the roof. While these rail systems are effective in providing suitable fall protection, the rail systems can cause damage to the roofs and can be damaged by environmental conditions on the roof Accordingly, there is a need in the art for an improved fall protection device.

SUMMARY OF THE INVENTION

The present invention provides a fall protection device which overcomes at least some of the above-note problems of the related art. According to the present invention, a fall protection device comprises a plurality of vertical members each having a lower end, a plurality of horizontal members connecting the vertical members, and a plurality of bearing feet each having a connecting portion and a bearing portion, Each bearing foot is secured to the lower end of one of said plurality of vertical members so that the bearing portion of the bearing feet support the vertical members above the roof. A hardness of the bearing portion is greater than a hardness of the connecting portion.

According to another aspect of the present invention, a fall protection device comprises at least one rail section having a vertical member with a lower end, and a bearing foot having a connecting portion and a bearing portion. The bearing foot is secured to the lower end of the vertical member by the connecting portion so that the bearing portion supports the vertical member above the roof. A hardness of the bearing portion is greater than a hardness of the connecting portion.

According to yet another aspect of the present invention, a fall protection device comprises at least one rail section having a vertical member and a bearing foot having a connecting portion and a bearing portion. The vertical member is in the form of a metal tube having an open lower end. The bearing foot is secured to the lower end of the vertical member by the connecting portion so that the bearing portion supports the vertical member above the roof. The connecting portion of the bearing foot extends into the open lower end of the tube and resiliently engages an interior surface of the tube to secure the bearing foot thereto. A hardness of the bearing portion is greater than a hardness of the connecting portion. The connecting portion and the bearing portion are plastic and co-molded so that the bearing foot is of unitary construction.

BRIEF DESCRIPTION OF THE DRAWINGS

These and further features of the present invention will be apparent with reference to the following description and drawing, wherein.

Figure 1:
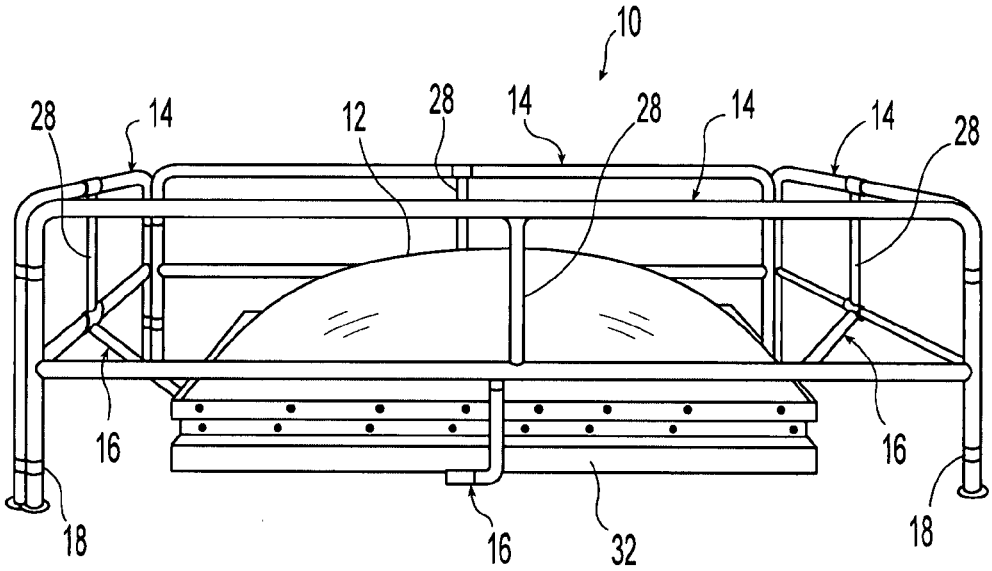
FIG. 1 is a perspective view of a fall protection device for a domed skylight according to the present invention.
Figure 2:
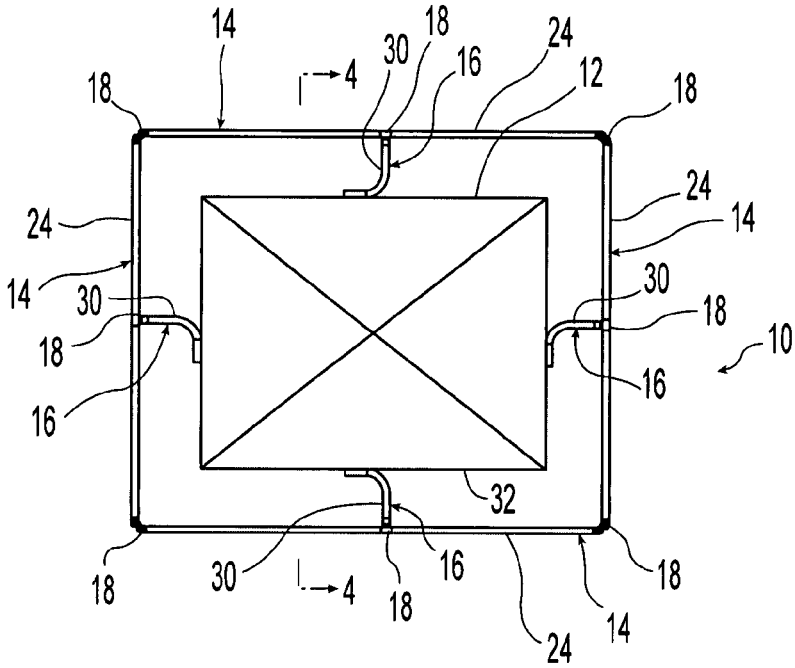
FIG. 2 is a top plan view of the fall protection device of FIG. 1.
Figure 3:
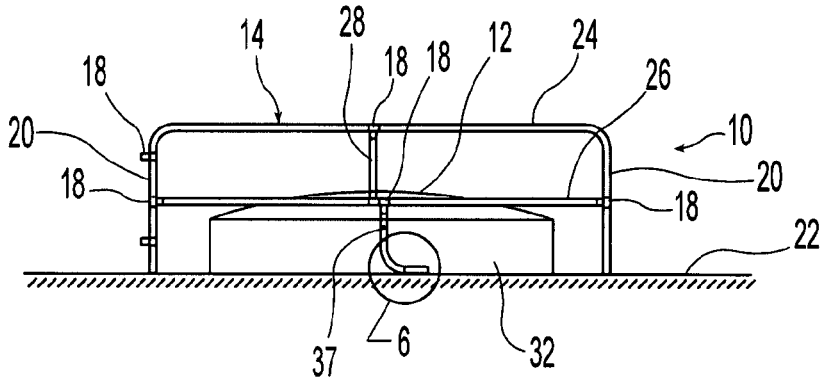
FIG. 3 is a side elevational view of the fall protection device of FIGS. 1 and 2.
Figure 4:
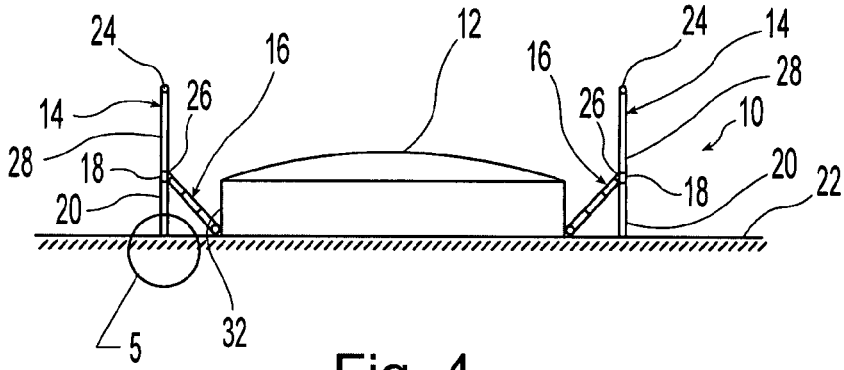
FIG. 4 is a cross-sectional view taken along line 4-4 of FIG. 2.
Figure 5:
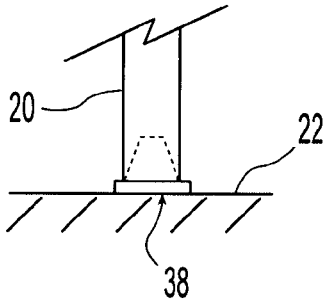
FIG. 5 is an enlarged fractional view, in cross-section, taken from detail 5 of FIGS. 4 and 11 and showing a bearing foot.
Figure 6:
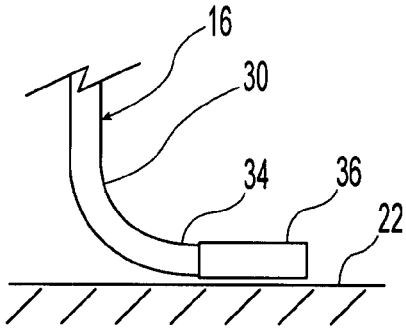
FIG. 6 is an enlarged fractional view taken from detail 6 of FIGS. 3 and 10 and showing a sleeve.

The specific design features of a fall protection device as disclosed herein, including, for example, specific dimensions of the components will be determined in part by the particular intended application and use environment. All references to direction and position, unless otherwise indicated, refer to the orientation of the fall protection device illustrated in the drawings. In general, up or upward refers to an upward direction out of the plane of the paper in FIG. 2 and down or downward refers to a downward direction into the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved fall protection devices disclosed herein. The following detailed discussion of various alternative and preferred embodiments will illustrate the general principles of the invention with reference to fall protection devices for use with domed skylights and long architectural skylights located on the roof of a building. Other embodiments suitable for other applications will be apparent to those skilled in the art given the benefit of this disclosure.

Referring now to the drawings, FIGS. 1 to 9 illustrate a fall protection device 10 for a domed skylight 12 according to a first embodiment of the present invention. The fall protection device 10 includes a plurality of frame or rail sections 14 and wedge members 16. The illustrated fall protection device 10 has four rail sections 14, with one of the rail sections 14 located on each of the four sides of the domed skylight 12 to form a rectangular-shaped rail encircling the domed skylight 12. The rail sections 14 are secured together at their ends in any suitable manner such as the illustrated connectors 18. It should be appreciated that other quantities of rail sections 14 can be utilized and/or other shapes or kinds of rail sections 14 can be utilized within the scope of the present invention.

Each of the illustrated rail sections 14 include a pair of laterally spaced-apart vertically extending vertical members 20 which are supported on a building roof 22 at their lower ends and horizontally extending, vertically spaced apart upper and lower horizontal members 24, 26 extending between and connecting the vertical members 20. The illustrated rail sections 14 also includes a vertical support 28 extending between and connecting the upper and lower horizontal members 24, 26 midway between the vertical members 20. It is noted that other quantities of vertical members 20, horizontal members 24, 26, and/or supports 28 can be utilized within the scope of the present invention. The vertical and horizontal members 20, 24, 26 are preferably tubes. The tubes are preferably electro-galvanized steel tubes but other suitable materials can be utilized such as, for example, aluminum, stainless steel, structural or reinforced plastic, or fiberglass. The vertical members 20, the horizontal members 24, 26, and the supports 28 are rigidly secured together in any suitable manner such as the illustrated connectors 18. It is also noted that the illustrated vertical members 20 and the upper horizontal member 24 are formed as one unitary piece or component by bending a single length of tube but alternatively can be separate components secured together. The vertical members 20, the horizontal members 24, 26, and the supports 28 are preferably sized and shaped to form the rail section 14 in a manner in which it will at least partially support a person falling against it to prevent collapse of the rail section 14 and prevent the person from falling past the rail section 14 to the domed skylight 12.

The illustrated wedge member 16 is a telescoping tube 30, having inner and outer longitudinally sliding portions lockable in a plurality of positions to selectively adjust the length of the tube 30, secured to the rail section 14 and having a free end engaging a shoulder or curb 32 of the roof or domed skylight 12. The free or engagement portion of the illustrated wedge member 16 is a laterally bent portion 34. Preferably a sleeve or cover 36 is provided on the engagement portion to protect the roof 22 and/or domed skylight 12. The sleeve 36 can be formed of any suitable material and any suitable dimensions such as, for example, a vinyl sleeve having a thickness of about 0.080 inches. The wedge member 16 can be secured to the rail section 14 in any suitable manner such as the illustrated connector 18. The illustrated wedge member 16 is secured to the lower horizontal member 26 about midway between the vertical members 20 so that the wedge member 16 is located at or near the center of the side of the domed skylight 12. While the illustrated embodiment includes a single wedge member 16 for each rail section 14, it is noted that other quantities of wedge members 16 can be utilized. It is also noted that the wedge members 16 can alternatively take any other suitable form. During installation, the length of the telescoping tube 30 is increased until the wedge member 16 firmly engages the roof 22 and/or domed skylight 12 and is locked in place. The telescoping tube 30 can be locked in any suitable manner such as the illustrated set screw 37. With the wedge members 16 firmly engaged on opposed sides of the domed skylight 12, the rail sections 14 are firmly wedged in place relative to the domed skylight 12.

Figure 7:
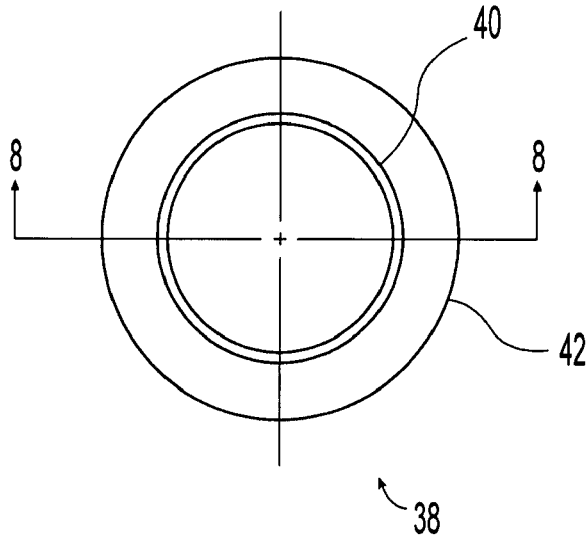
FIG. 7 is a top plan view of a bearing foot of the fall protection device of FIGS. 1 to 6.
Figure 8:
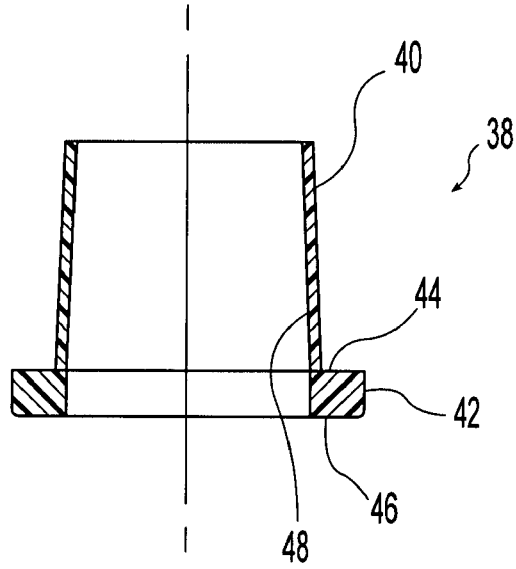
FIG. 8 is a cross-sectional view taken along line 8-8 of FIG. 7.
Figure 9:
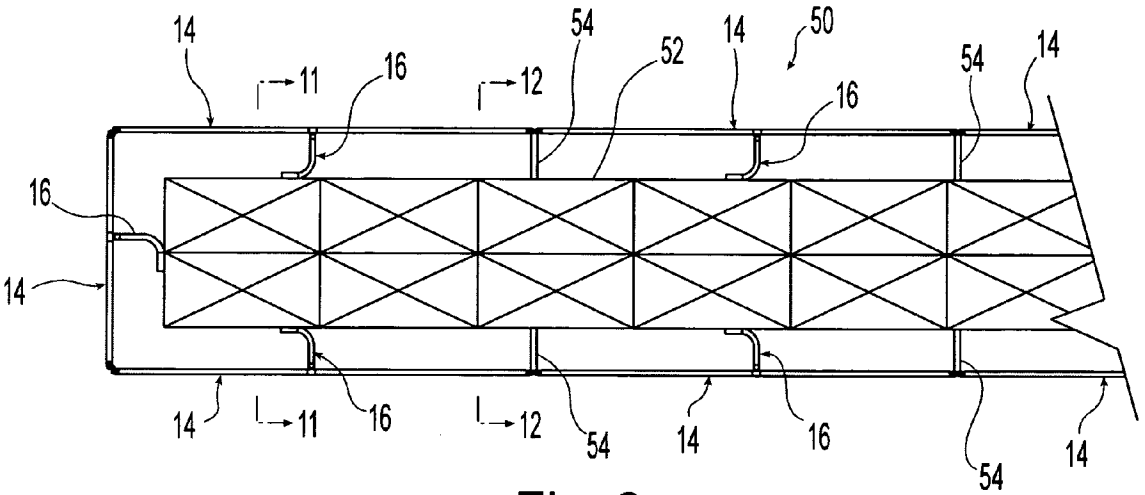
FIG. 9 is top plan view of a fall protection device for a long architectural skylight according to another embodiment the present invention.
Figure 10:
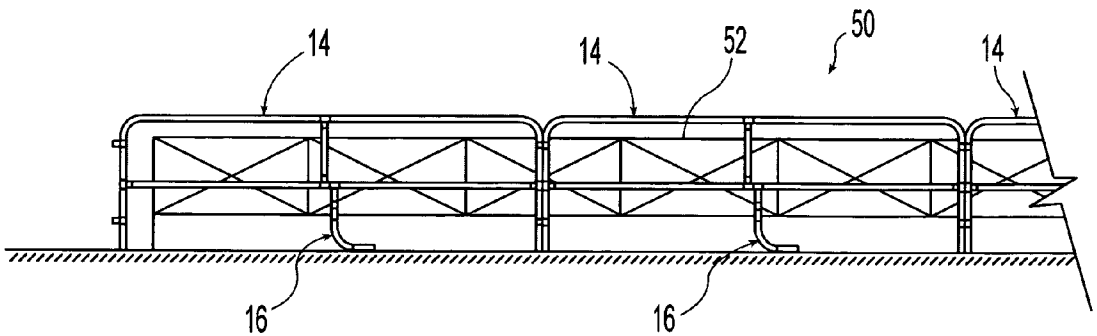
FIG. 10 is a side elevational view of the fall protection device of FIG. 9.
Figure 11:
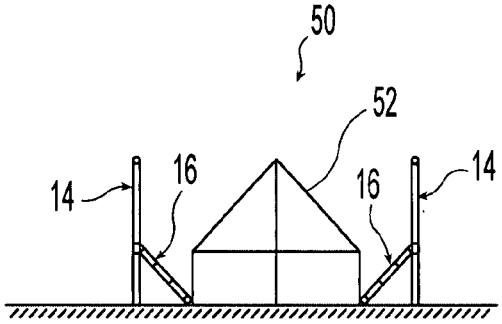
FIG. 11 is a cross-sectional view taken along line 11-11 of FIG. 9.
Figure 12:
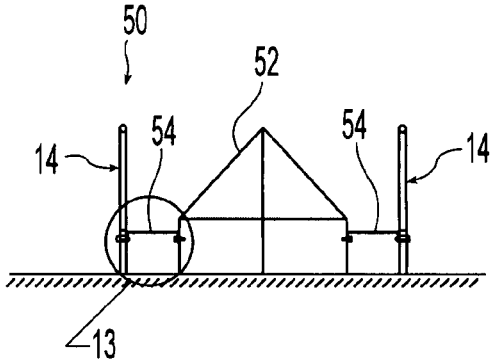
FIG. 12 is a cross-sectional view taken along line 12-12 of FIG. 9.
Figure 13:
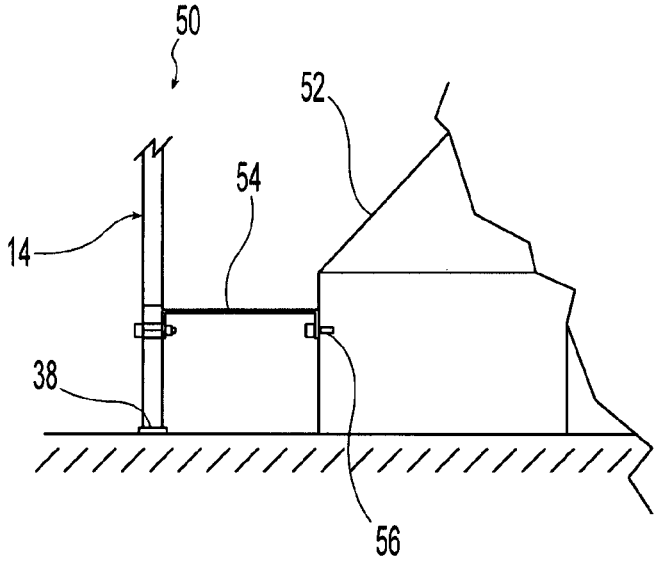
FIG. 13 is an enlarged fractional view taken from detail 13 of FIG. 12 and showing a tension tie.

Each of the lower ends of the vertical members 20 are provided with a bearing foot 38 which spaces the vertical member 20 from the roof 22 to protect the roof 22 from damage by the vertical member 20. As best shown in FIGS. 7 and 8, the illustrated bearing foot 38 includes a body or connecting portion 40 sized and shaped for connection to the lower end of the vertical member 20 and a flange or bearing portion 42 for directly engaging the roof and supporting the fall protection device 10 on the roof 22. The illustrated connecting portion 40 is sized and shaped for insertion into the open bottom end the tube forming the vertical member 20 in a plug-like manner but it is noted that the connecting portion 40 could alternatively be sized and shaped to extend over the end of the tube forming the vertical member 20 in a cap-like manner. The illustrated connecting portion 40 is frusto-conical shaped and sized to engage the inner surface of the tube with an interference fit. The connecting portion 40 is preferably flexible and elastic enough to partially deform upon insertion into the tube so that the connecting portion 40 is in an unrelaxed or resiliently deformed state when within the tube so that the connecting portion 40 applies a force against the inner surface of the tube to increase the force necessary to withdrawal the connecting portion 40 from the tube. The illustrated bearing portion 42 outwardly extends in a radial direction from the lower end of the connecting portion 40. The bearing portion 42 forms an upper surface 44 for engagement with the end of the tube forming the vertical member 20 and a lower surface 46 for direct engagement with the roof. The bearing portion 42 preferably has a thickness of at least about 0.25 inches but other suitable thicknesses can be utilized. The outer diameter of the bearing portion 42 is preferably larger than the outer diameter of the tube in order to increase the area of the lower or bearing surface 46 and spread load over a greater surface area of the roof 22. The bearing foot 38 preferably forms a passage 48 therethrough to connect the interior space within the tube forming the vertical member 20 with the space outside the tube so that the bearing foot 38 does not seal the tube closed. As a result, any liquid which enters the tube can easily flow out of the tube with the aid of gravity. The illustrated passage 48 extends vertically through the entire length of the bearing foot 38 such that the bearing portion 42 is annular shaped. The inner and outer edges of the lower surface 46 of the bearing portion 42 are preferably free of sharp corners to prevent damage to the roof 22. The illustrated bearing portion 42 is provided with rounded or radiused outer and inner edges. It is noted that the bearing foot 38 can alternatively be sized and shaped in any other suitable manner.

The bearing foot 38 is preferably formed of a material which protects the roof 22 against damage due to contact by the fall protection device 10. The bearing foot 38 is preferably formed of a plastic material such as, for example, polypropylene. Polypropylene and other suitable plastics provide desirable resistance to UV radiation damage which is not provided by some alternative materials such as, for example, rubber. The bearing foot 38 is preferably provided with dual durometers or hardnesses. The bearing portion 42 is preferably formed with a material having a greater hardness than the material forming the connecting portion 40. The bearing portion 42 preferably has a greater hardness to resist penetration of the metal vertical member 20 into the upper surface 44 due to the weight of the fall protection device 10. The connecting portion 40 preferably has a lesser hardness so that it is flexible and resilient to adequately mate with the tubular vertical member 20. The bearing foot 30 can be co-molded of plastics having desired properties for both the bearing portion 42 and the connecting portion 40. It is believed that both hardness can fall within the range of Shore A 90 hardness and still provide the separate and distinct properties desired for the separate portions 40, 42. It is noted that the bearing foot is preferably of unitary, that is, of one piece construction of continuous material rather than separate members attached or secured together.

FIGS. 9 to 13 illustrate a fall protection device 50 for a long architectural skylight 52 according to a second embodiment of the present invention. This second embodiment illustrates that multiple rail sections 14 can be utilized along desired sides of the architectural skylight 52 which may be too long for a single rail section 14. This embodiment also illustrates that the rail sections 14 can be rigidly secured to the frame of the architectural skylight 52 with a tension tie 54 to substantially prevent movement of the rail sections 14. In the illustrated embodiment, the tension ties 54 are provided at ends of rail sections 14 which are not located at corners of the skylight architectural 52.

Each of the tension ties 54 preferably extend from the rail section 14 to an existing bolt or other suitable fastening point 56 of the architectural skylight 52 so that no modification of the architectural skylight 52 is necessary to secure the tension tie 54 thereto. The tension tie 54 can be of any suitable type to rigidify the fall protection device 10. Preferably the length of the tension tie 54 is adjustable such as, for example, by a turnbuckle to adjust the tension supplied to the rail section 14 by the tension tie 54. During installation, the length of the tension ties 54 are preferably adjusted until the fall protection device 50 is firmly is locked in place. With the wedge members 16 firmly engaged on opposed sides of the domed skylight 12 and the tension ties securing the ends of the sections 14, the rail sections 14 are firmly held in place relative to the architectural skylight 52.

It should be apparent from the forgoing detailed description that the fall protection device of the present invention does not penetrate the roof or skylight curb membranes thereby maintaining the integrity of the roof and any existing warranty.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A combination of a roof and a fall protection device, said combination comprising:

a roof having an opening therein;

a curb about the opening;

a fall protection device about at least a portion of the opening and comprising:

a plurality of vertical members each having a lower end;

a plurality of horizontal members connecting the vertical members;

a plurality of length-adjustable wedge members each having one end secured to at least one of the horizontal members and the vertical members and a free end engaging the curb, wherein each wedge member comprises telescoping tubes; and a plurality of bearing feet each having a connecting portion and a bearing portion;

wherein the wedge members firmly engage the curb on opposed sides of the opening so that the vertical members and the horizontal members are firmly wedged in place relative to the opening;

wherein an engagement portion of each wedge member is provided with a protective sleeve;

wherein each bearing foot is secured to the lower end of one of said plurality of vertical members so that the bearing portion of the bearing feet support the vertical members above the roof;

wherein the bearing portion has an upper surface, and a lower surface parallel with the upper surface and spaced from the upper surface;

wherein the lower surface of the bearing portion rests on the roof and the lower end of the vertical member engages the upper surface of the bearing portion to support the vertical member above the roof so that the vertical members do not engage the roof;

wherein the connecting portion of the bearing foot is frusto-conical shaped and upwardly extends from the upper surface of the bearing portion wherein the frusto-conical shaped connecting portion engages the vertical member and is resiliently deformed to secure the bearing foot to the vertical member with an interference fit and resist removal of the bearing foot from the vertical member;

wherein a first material forming the bearing portion has a first material hardness greater than a second material hardness of a second material forming the connecting portion;

wherein the second material of the connecting portion and the first material of the bearing portion are each plastic materials and co-molded so that each bearing foot is of unitary construction; and wherein the fall protection device engages the roof with the bearing portion of the bearing feet and the curb with the protective sleeve of the wedge members so that the fall protection device does not penetrate the roof and the curb.

2. The combination of a roof and a fall protection device of claim 1, wherein the plastic materials are each polypropylene.

3. The combination of a roof and a fall protection device of claim 1, wherein each of the plurality of vertical members is in the form of a tube.

4. The combination of a roof and a fall protection device of claim 3, wherein each bearing foot has an axially extending passage formed therein which extends through both the bearing portion and the connecting portion and communicates an interior space of the tube with ambient space outside the tube so that any liquid that enters the tube flows out of the bottom of the tube through the passage in the bearing foot by gravity.

5. The combination of a roof and a fall protection device of claim 3, wherein the connecting portion of the bearing foot extends into an open lower end of the tube and resiliently engages an interior surface of the tube to secure the bearing foot thereto.

6. The combination of a roof and a fall protection device of claim 1, wherein an edge formed at the intersection of the circular outer periphery of the bearing portion and the lower surface of the bearing portion is rounded and free of sharp corners.

7. The combination of a roof and a fall protection device of claim 1, wherein the bearing portion has a thickness of at least 0.25 inches.

8. The combination of a roof and a fall protection device of claim 1, wherein each wedge member has a bent end forming the free end and receiving the protective sleeve.

9. A combination of a roof and a fall protection device, said combination comprising:

a roof having an opening therein;

a curb about the opening;

a fall protection device about at least a portion of the opening and comprising:

a plurality of rail sections each having at least one vertical member and at least one horizontal member;

wherein the vertical member has a lower end;

a plurality of length-adjustable wedge members each having one end secured to at least one of the rail sections and a free end engaging the curb;

wherein each wedge member comprises telescoping tubes; and a bearing foot having a connecting portion and a bearing portion;

wherein the wedge members firmly engage the curb on opposed sides of the opening so that the rail sections are firmly wedged in place relative to the opening;

wherein an engagement portion of each wedge member is provided with a protective sleeve;

wherein the bearing foot is secured to the lower end of the vertical member by the connecting portion so that the bearing portion supports the vertical member above the roof;

wherein the bearing portion has an upper surface, and a lower surface parallel with the upper surface and spaced from the upper surface;

wherein the lower surface of the bearing portion rests on the roof and the lower end of the vertical member engages the upper surface of the bearing portion to support the vertical member above the roof so that the vertical members do not engage the roof;

wherein the connecting portion of the bearing foot is frusto-conical shaped and upwardly extends from the upper surface of the bearing portion wherein the frusto-conical shaped connecting portion engages the vertical member and is resiliently deformed to secure the bearing foot to the vertical member with an interference fit and resist removal of the bearing foot from the vertical member;

wherein a first material forming the bearing portion has a first material hardness greater than a second material hardness of a second material forming the connecting portion; and wherein the fall protection device engages the roof with the bearing portion of the bearing foot and the curb with the protective sleeve of the wedge members so that the fall protection device does not penetrate the roof and the curb.

10. The combination of a roof and a fall protection device of claim 9, wherein the bearing foot is molded of plastic.

11. The combination of a roof and a fall protection device of claim 10, wherein the plastic is polypropylene.

12. The combination of a roof and a fall protection device of claim 9, wherein the vertical member is in the form of a tube.

13. The combination of a roof and a fall protection device of claim 12, wherein the bearing foot has an axially-extending passage formed therein which extends through both the bearing portion and the connecting portion and communicates an interior space of the tube with ambient space outside the tube so that any liquid that enters the tube flows out of the bottom of the tube through the passage in the bearing foot by gravity.

14. The combination of a roof and a fall protection device of claim 12, wherein the connecting portion of the bearing foot extends into an open lower end of the tube and resiliently engages an interior surface of the tube to secure the bearing foot thereto.

15. The combination of a roof and a fall protection device of claim 9 wherein an edge formed at the intersection of the circular outer periphery of the bearing portion and the lower surface of the bearing portion is rounded and free of sharp corners.

16. The combination of a roof and a fall protection device of claim 9, wherein the bearing portion has a thickness of at least 0.25 inches.

17. The combination of a roof and a fall protection device of claim 9, wherein the second material of the connecting portion and the first material of the bearing portion are each plastic materials and co-molded so that the bearing foot is of unitary construction.

18. The combination of a roof and a fall protection device of claim 9, wherein each wedge member has a bent end forming the free end and receiving the protective sleeve.

19. A combination of a roof and a fall protection device, said combination comprising:

a roof having an opening therein;

a curb about the opening;

a fall protection device about at least a portion of the opening and comprising:

a plurality of rail sections each having at least one vertical member and at least one horizontal member;

wherein the vertical member is in the form of a metal tube having an open lower end;

a plurality of length-adjustable wedge members each having one end secured to the rail section and a free end engaging the curb;

wherein each wedge member comprises telescoping tubes; and a bearing foot having a connecting portion and a bearing portion;

wherein the wedge members firmly engage the curb on opposed sides of the opening so that the rail sections are firmly wedged in place relative to the opening;

wherein an engagement portion of each wedge member is provided with a protective sleeve;

wherein each wedge member has a bent end forming the free end and receiving the protective sleeve;

wherein the bearing foot is secured to the lower end of the vertical member by the connecting portion so that the bearing portion supports the vertical member above the roof;

wherein the bearing portion has an upper surface, and a lower surface parallel with the upper surface and spaced from the upper surface;

wherein the lower surface of the bearing portion rests on the roof and the lower end of the vertical member engages the upper surface of the bearing portion to support the vertical member above the roof so that the vertical members do not engage the roof;

wherein the connecting portion of the bearing foot is frusto-conical shaped and upwardly extends from the upper surface of the bearing portion wherein the frusto-conical shaped connecting portion of the bearing foot extends into the open lower end of the tube and is resiliently deformed to secure the bearing foot to the vertical member with an interference fit and resist removal of the bearing foot from the vertical member;

wherein the bearing foot has an axially-extending passage formed therein which extends through both the bearing portion and the connecting portion and communicates an interior space of the tube with ambient space outside the tube so that any liquid that enters the tube flows out of the bottom of the tube through the passage in the bearing foot by gravity;

wherein a first material forming the bearing portion has a first material hardness greater than a second material hardness of a second material forming the connecting portion;

wherein the second material of the connecting portion and the first material of the bearing portion are each a plastic material and co-molded so that the bearing foot is of unitary construction; and wherein the fall protection device engages the roof with the bearing portion of the bearing feet and the curb with the protective sleeve of the wedge members so that the fall protection device does not penetrate the roof and the curb.

* * * * *